United States Patent [19]

Brown

[11] Patent Number: 5,071,282

[45] Date of Patent: Dec. 10, 1991

[54] HIGHWAY EXPANSION JOINT STRIP SEAL

[75] Inventor: Howard R. Brown, Bowling Green, Ohio

[73] Assignee: The D. S. Brown Company, Inc., North Baltimore, Ohio

[21] Appl. No.: 710,321

[22] Filed: Jun. 4, 1991

Related U.S. Application Data

[63] Continuation of Ser. No. 469,220, Jan. 24, 1990, Pat. No. 5,035,533, which is a continuation-in-part of Ser. No. 272,529, Nov. 17, 1988, Pat. No. 4,896,994.

[51] Int. Cl.[5] ..... E01C 11/02; E01C 11/04

[52] U.S. Cl. ..... 404/68; 404/67

[58] Field of Search ..... 404/64, 65, 68, 69

[56] References Cited

U.S. PATENT DOCUMENTS

| | | | |
|---|---|---|---|
| 3,994,609 | 11/1976 | Puccio | 404/69 |
| 4,018,539 | 4/1977 | Puccio | 404/69 |
| 4,067,660 | 1/1978 | Puccio | 404/69 |
| 4,140,419 | 2/1979 | Puccio | 404/69 |
| 4,179,226 | 12/1979 | Puccio | 404/64 |
| 4,290,249 | 9/1981 | Mass | 404/65 X |
| 4,305,680 | 12/1981 | Rauchfuss, Jr. | 404/74 |
| 4,367,976 | 1/1983 | Bowman | 404/64 X |
| 4,423,979 | 1/1984 | Brown | 404/69 |

*Primary Examiner*—Ramon S. Britts

*Assistant Examiner*—Nancy P. Connolly

*Attorney, Agent, or Firm*—Willian Brinks Olds Hofer Gilson & Lione

[57] ABSTRACT

An expansion joint strip seal for use between spaced apart ends of sections of a highway, bridge, or the like, the strip seal having an elongate metallic rail with a C-shaped cavity therein embedded in the end of one of the sections, a second elongate metallic rail with a reverse C-shaped cavity therein embedded in the end of an adjacent section, and an elastomeric, elongate membrane having ear portions extending along its opposed edges, each of the ear portions being sealingly engaged by one of the metallic rails. The membrane, which is formed integrally in a single piece, has a central web portion, which is generally V-shaped in cross section, and each ear portion has an enlarged end portion and a transitional portion between the enlarged end portion and the central web portion. The transitional portion has upper and lower planar surfaces which sealingly engage planar sealing surfaces of an entrance of each metallic rail that engages such ear portion. The entrance of the metallic rail leads into the cavity therein and the end portion of the membrane is engaged in the cavity. The end portion of the membrane is provided with spaced apart upper and lower voids to facilitate the compressing of the end portion to thereby facilitate its insertion into the cavity of the rail.

5 Claims, 3 Drawing Sheets

HIGHWAY EXPANSION JOINT STRIP SEAL

Cross-Reference To Related Applications

This application is a continuation of my co-pending application Ser. No. 07/469,220, now U.S. Pat. No. 5,035,533, issued July 30, 1991, which, in turn, was a continuation-in-part of my co-pending application Ser. No. 272,529, filed on Nov. 17, 1988, now U.S. Pat. No. 4,896,994, issued on Jan. 30, 1990.

BACKGROUND OF THE INVENTION

1. Field of the Invention

This invention relates to a sealing structure for use between spaced apart ends of adjacent concrete sections of a highway, or adjacent sections of a bridge, to sealingly accommodate changes in the spacing between the sections as a result of thermal contraction and expansion.

2. Description of the Prior Art

U.S. Pat. No. 4,290,713 (D. D. Brown et al) discloses a highway expansion joint strip seal in which each of the opposed ends of an elastomeric strip is provided with a downwardly extending enlargement or bead which is engaged in an upwardly facing opening of a metallic frame. Each metallic frame for use in such strip seal is fabricated by roll forming, that is, from a flat plate by rolling operations, which is a relatively expensive manufacturing procedure. Elastomeric strips of the type illustrated in this patent have also been used in conjunction with metallic frames which are formed by extrusion, also an expensive manufacturing procedure. U.S. Pat. No. 3,994,609 (G. S. Puccio) discloses a highway expansion joint strip seal in which each of the opposed ends of an elastomeric strip is provided with an enlarged bead portion with an outwardly facing convex curved end which is received in a generally C-shaped cavity of a metallic edge member. The edge members of this reference are manufactured by extrusion. Further, expansion joint strip seals according to the prior art have been difficult to assemble due to the need to insert the enlarged ends of the elastomeric strip into the somewhat smaller opening of metallic frame of edge members. To the extent that the difficulty of assembly has been reduced by increasing the size of the openings in the metallic frame or edge members or by reducing the size of the enlarged ends of the elastomeric strip, the resistance of the elastomeric member to being pulled out of the metallic frame or edge member has been undesirably reduced.

SUMMARY OF THE INVENTION

According to the present invention there is provided an expansion joint strip seal for a highway or a bridge which is made up of a collapsible elastomeric membrane whose opposed ends are provided with enlarged ear portions, and a pair of spaced apart, opposed metallic frame or rail members each of which is embedded at an edge of a concrete highway or bridge section and each of which sealingly engages one of the opposed ends of the elastomeric strip. The elastomeric membrane is made up of an elongate, generally horizontally extending web portion, which is generally V-shaped in cross-section to provide the needed flexibility for movement of the opposed ends toward and away from each other, and a pair of enlarged, generally vertically extending ear portions which are integrally joined to opposed ends of the web portion at locations of the ear portions which are closer to the bottoms thereof than to the tops. Each of the ear portions is provided with a pair of spaced apart internal voids which facilitate the compression and distortion of the ear portion that is needed to insert it into a generally C-shaped cavity of the metallic rail member which receives such ear portion, and the eccentric positioning of each ear portion with respect to the web portion serves to provide a turning moment on the ear portion when the web portion is under tension, to thereby twist the ear portion within the cavity of the rail member in which it is engaged and thereby increase the pullout resistance of the ear portion. Further, the configuration of the membrane is such that it is feasible to produce suitable metallic frame or rail members to sealingly receive ear portions at the opposed edges of the membrane by a rolling procedure, at a substantial reduction in the manufacturing costs of such frame or rail members.

Accordingly, it is an object of the present invention to provide an improved expansion joint strip seal. It is a further object of the present invention to provide an improved highway expansion joint strip seal. More particularly, it is an object of the present invention to provide a highway expansion joint strip seal with reduced assembly difficulty between an elastomeric membrane and metallic frame members which sealingly engage opposed ends of the elastomeric membrane, and with improved pullout resistance between the elastomeric membrane and the metallic frame members. It is also an object of the present invention to provide an expansion joint strip seal in which an elastomeric membrane component thereof is of a configuration which permits the use of machined hot rolled metallic frame or rail members to sealingly engage enlarged ear portions at opposed edges of such membrane. It is also an object of the present invention to provide an improved elastomeric membrane for use in an expansion joint strip seal. For a further understanding of the present invention and the objects thereof, attention is directed to the drawing and the following description thereof, to the detailed description of the preferred embodiment and to the appended claims.

DETAILED DESCRIPTION OF THE PREFERRED EMBODIMENT

Figure 1:
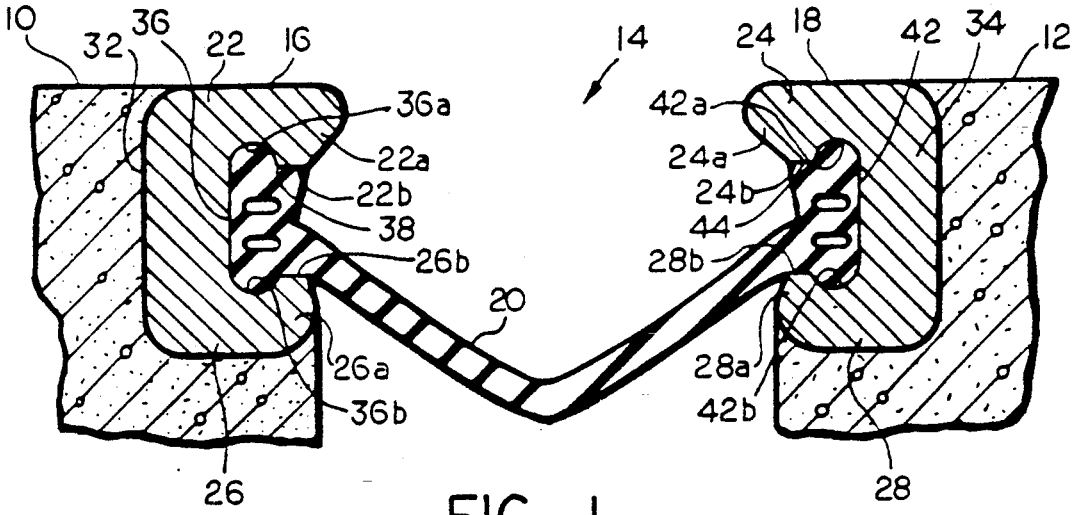
FIG. 1 is a fragmentary cross-sectional view of a joint between adjacent sections of a highway, the joint being provided with a strip seal according to a preferred embodiment of the present invention.

As is illustrated in FIG. 1, a typical joint between the end of a highway and an adjacent end of a bridge, or between the ends of adjacent sections of a bridge, includes multiple concrete sections, such as sections 10 and 12, whose adjacent ends 10*a* and 12*a*, respectively, are spaced apart from one another to accommodate thermal expansion and contraction of the sections 10 and 12 due to temperature changes. A strip seal, indicated generally at 14, is inserted between the ends 10*a* and 12*a* of the sections 10 and 12 to prevent moisture, dirt and other debris from filling the space between the ends 10*a* and 12*a*, and possibly wedging thereunder, with resulting damage to or deterioration of the sections 10 and 12. Of course, it is to be understood that the strip seal 14 may be used to provide for expansion and contraction between adjacent ends of other planar structures.

The strip seal 14 is made up of generally C-shaped elongate metallic rails 16 and 18, and an elongate elastomeric membrane 20 which extends between the metallic rails 16 and 18. The metallic rails 16 and 18 are embedded in the concrete sections 10 and 12, respectively, and various types of anchoring devices, not shown, may be attached to the metallic rails 16 and 18 to assist in securely retaining them in the concrete sections 10 and 12. The use of such anchoring devices in connection with the anchoring of the metallic rails of a prior art highway strip seal in concrete highway sections is known in the prior art. See, for example, the aforesaid U.S. Pat. No. 4,290,713.

Each of the metallic rails 16 and 18 is provided with a generally horizontally extending top flange, elements 22 and 24, respectively, a generally horizontally extending bottom flange, elements 26 and 28, respectively, and a generally vertically extending web, elements 32 and 34, respectively. The web 32 of the metallic rail 16 extends from the left hand end of the top flange 22 to the left hand end of the bottom flange 26, to impart a generally C-shaped configuration to the metallic rail 16 with an internal cavity 36 having a restricted opening 38 that extends to the right, and the web 34 of the metallic rail 18 extends from the right hand end of the top flange 24 to the right hand end of the bottom flange 28 to impart a generally reverse, C-shaped configuration to the metallic rail 18 with an internal cavity 42 having a restricted opening 44 that extends to the left. The top flanges 22 and 24 have downwardly depending portions 22*a* and 24*a*, respectively, each of which ends in a horizontally extending flat, planar surface area, elements 22*b* and 24*b*, respectively, and the bottom flanges 26 and 28 have upwardly extending portions 26*a* and 28*a*, respectively, each of which ends in a horizontally extending flat, planar surface area, elements 26*b* and 28*b*, respectively. Thus, the opening 38 in the rail 16, which is the vertical spacing between the surface 22*b* and the surface 26*b*, has less vertical extent than the cavity 36 and is entirely spaced between the upper and lower extremities thereof, elements 36*a* and 36*b*, respectively, which are semi-circular in cross-sectional configuration, and the opening 44 in the rail 18, which is the vertical spacing between the surface 24*b* and the surface 28*b*, has less vertical extent than the cavity 42 and is entirely spaced between the upper and lower extremities thereof, elements 42*a* and 42*b* respectively, which are also semi-circular in cross-sectional configuration.

Each of the rails 16 and 18 may be manufactured in one piece from steel in the illustrated, mirror image, complex configurations relatively inexpensively by conventional hot rolling techniques of the type utilized in steel mills in the manufacture of I beams and other structural steel shapes, subject, of course, to a need to machine the surfaces of the cavities 36 and 42 in the rails 16 and 18, respectively, including the surfaces of the openings 38 and 44, but nevertheless without the need to employ more expensive manufacturing techniques such as extrusion or roll forming. Of course, it is to be understood that it is also contemplated that the rails 16 and 18 may also be manufactured by extrusion or roll forming, if the product characteristics which result from either of such manufacturing processes are desired.

The elongate elastomeric membrane 20 is formed integrally in a single piece from a suitable elastomeric material, for example polychloroprene with a Durometer A hardness of approximately 60±5, and this may be done by extrusion. The membrane 20 has a generally horizontally extending web portion 52, which is generally V-shaped in cross section, and generally vertically extending, mirror image ear portions 54 and 56 which are attached to the opposed ends of the web portion 52, the V-shape of the web portion 52 facilitating the changes in spacing between the ear portions 54 and 56 to accommodate changes in spacing between the ends 10*a* and 12*a* of the highway sections 10 and 12. The ear portion 54 has a free end 54*a* which is sized and shaped to fit snugly within the cavity 36 of the rail 16, and a transitional portion 54*b* which is sized and shaped, and positioned relative to the free end 54*a*, to extend through and fit snugly within the opening 38 in the rail 16. Likewise, the ear portion 56 has a free end 56*a* which is sized and shaped to fit snugly within the cavity 42 of the rail 18, and a transitional portion 56*b* which is sized and shaped, and positioned relative to the free end 56*a*, to fit snugly within the opening 44 in the rail 18. Thus, the vertical extent of the free end 54*a* of the ear portion 54 of the membrane 20 is greater than the vertical extent of the opening 38 in the rail 16, and the free end 54*a* must be compressed in the vertical direction to permit it to be inserted through the opening 38 into the cavity 36 of the rail 16. To facilitate the compressing of the free end 54*a* of the ear portion 54, the free end 54*a* is provided with spaced apart, horizontally elongate internal cavities 62 and 64. Similarly, the vertical extent of the free end 56*a* of the ear portion 56 of the membrane 20 is greater than the vertical extent of the opening 44 in the rail 18, and the free end 54 is provided with spaced apart, horizontally extending elongate internal cavities 66 and 68 to facilitate the vertical compressing of the free end 56*a* to permit it to be inserted through the opening 44 into the cavity 42 of the rail 18. The cavity 62 is spaced a given distance from the top of the free end 54*a* of the ear 54 and the cavity 64 is spaced a slightly greater distance from the bottom of the free end 54*a*. Likewise, the cavity 66 is spaced a given distance from the top of the free end 56*a* of the ear 54 and the cavity 68 is spaced a slightly greater distance from the bottom of the free end 56*a*.

Sealing contact between the ear portion 54 of the elastomeric membrane 20 and the rail 16 primarily occurs at the surfaces 22*b* and 26*b* of the rail 16, and to this end the transitional portion 54*b* of the ear portion 54 is provided with parallel, upper and lower flat, planar surfaces 54*c* and 54*d*, respectively, which sealingly engage the surfaces 22*b* and 26*b*, respectively, of the rail 16 in surface to surface contact. Similarly, sealing contact between the ear portion 56 of the elastomeric membrane 20 and the rail 18 primarily occurs at the surfaces 24*b* and 28*b* of the rail 18, and to this end the transitional portion 56*b* of the ear portion is provided with parallel, upper and lower flat, planar surfaces 56*c* and 56*d*, respectively, which sealingly engage the surfaces 24*b* and 28*b*, respectively, of the rail 18 in surface to surface contact. To ensure proper sealing engagement between the transitional portion 54*b* of the ear portion 54 and the opening 38 in the rail 16, and proper sealing engagement between the transitional portion 56*b* of the ear portion 56 and the opening 44 in the rail 18, the relaxed or uncompressed spacing between the surfaces 54*c* and 54*d* must exceed the spacing between the surfaces 22*b* and 26*b*, and the relaxed or uncompressed spacing between the surfaces 56*c* and 56*d* must exceed the spacing between the surfaces 24*b* and 28*b*. For example, it has been found that good, water tight sealing can be obtained in a strip seal 14 of the type described when the relaxed or uncompressed spacing between the surfaces 54*c* and 54*d*, which is equal to that between the surfaces 56*c* and 58*d*, is 0.860 in., and with a spacing between the surfaces 22*b* and 26*b*, which is equal to that between the surfaces 24*b* and 28*b*, of 0.813 in..

Figure 2:
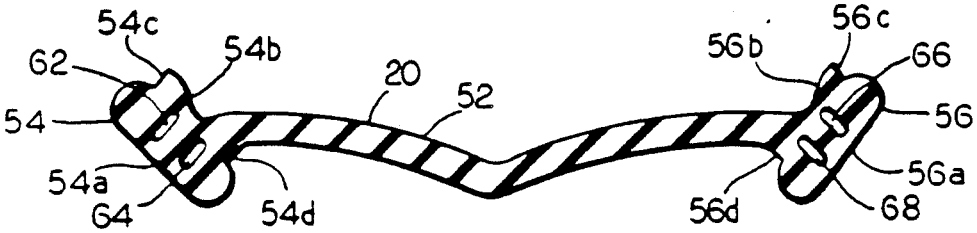
FIG. 2 is a cross-sectional view of the elastomeric membrane element of the strip seal illustrated in FIG. 1.

As is clear from a comparison of FIG. 2 and FIG. 1, in the relaxed condition of the elastomeric membrane 20, as is shown in FIG. 2, the ear portions 54 and 56 extend obliquely with respect to the horizon whereas in the assembled condition of the membrane 20 the ear portions extend vertically. Thus, a twisting movement is imparted to the ear portions 54 and 56 by the rails 16 and 18, respectively, which tends to increase the interference fit between the ear portions 54 and 56 and the openings 38 and 44, respectively, and thereby increase the resistance of the elastomeric membrane 20 to being pulled out of the rails 16 and 18 under a tensile load, for example, in exceptionally cold weather when the spacing between the ends 10*a* and 12*a* of the highway sections is large. Further, twisting of the ears 54 and 56 within the rails 16 and 18, respectively, under tensile load, is increased by positioning the junctures between the web portion 52 and the ear portions 54 and 56 eccentrically between the top and bottom of each such ear portion, preferably in alignment with the lower voids 64 and 68, respectively, and this further increases the resistance of the elastomeric member 20 to being pulled out of the rails 16 and 18 under a tensile load.

Figure 3:
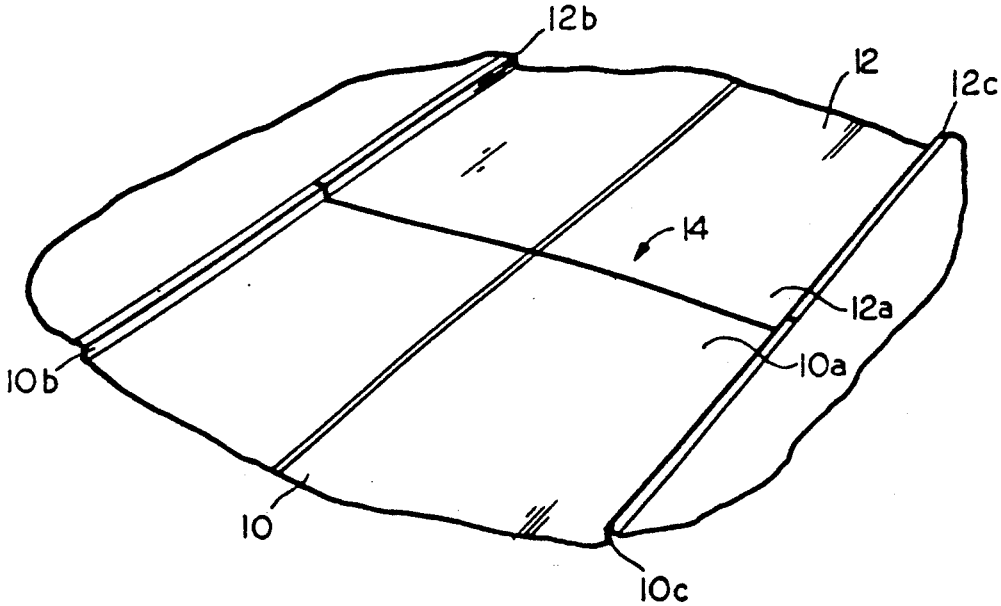
FIG. 3 is a fragmentary, perspective view of a section of a highway, including curbs, which incorporates a strip seal of the type illustrated in FIG. 1.

The use of voids 62 and 64 in the ear 54 of the elastomeric membrane 20, and the use of voids 66 and 68 in the ear 56 makes it possible to obtain fairly sharp upturns in the strip seal 14, for example, even 90° upturns. Thus, as is shown in FIG. 3, the strip seal 14 may be employed in a highway having sections 10 and 12 which have curbs 10*b* and 10*c*, and 12*b* and 12*c*, respectively, along the opposed edges thereof.

Figure 4:
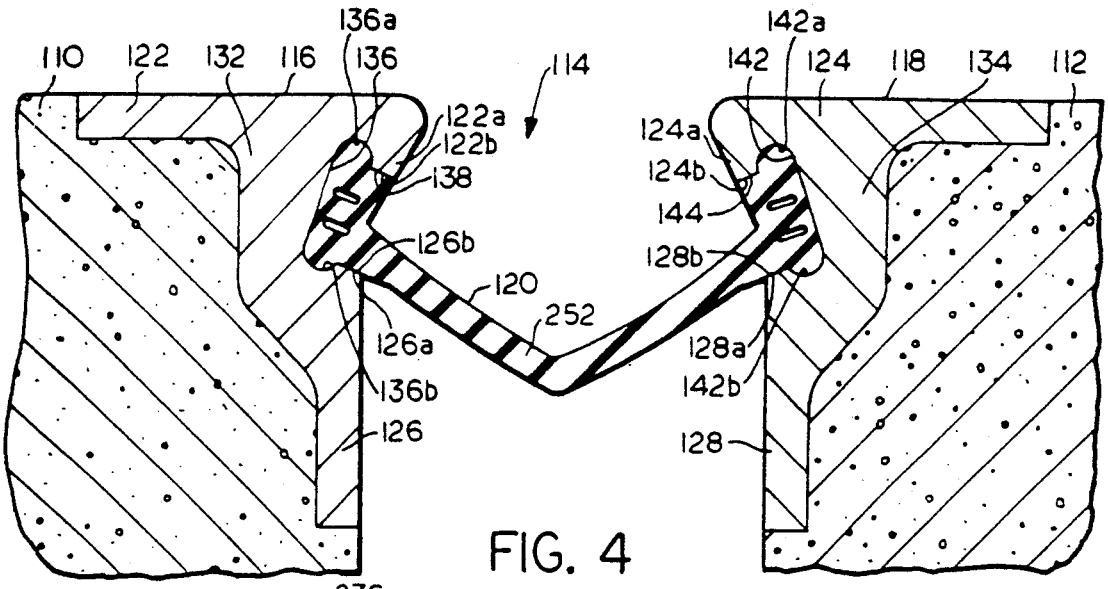
FIG. 4 is a view similar to FIG. 1 illustrating an alternative embodiment of the present invention.

In the embodiment of FIG. 4 elements which generally correspond to elements of FIGS. 1 and 2 are identified by a 100 series numeral, the last two digits of which are the same as the two digits of the corresponding element of FIGS. 1 and 2. In FIG. 4, a strip seal 114 is made up of elongate metallic rails 116 and 118 and an elongate elastomeric membrane 120 which extends between the metallic rails 116 and 118. The metallic rails 116 and 118 are embedded in the spaced apart ends of adjacent concrete sections 110 and 112.

Each of the metallic rails 116 and 118, which are of a somewhat different configuration than the rails 16 and 18 of FIG. 1, is provided with a generally horizontally extending top flange, elements 122 and 124, respectively, a generally vertically extending bottom flange, elements 126 and 128, respectively, and a generally vertically extending web, elements 132 and 134, respectively. The web 132 of the metallic rail 116 extends from the top flange 122 to the bottom flange 126, to impart a generally C-shaped configuration to an internal cavity 136 of the metallic rail 116. The cavity 136, which extends obliquely downwardly and outwardly to help to minimize the spacing between the rails 116 and 118, has a restricted opening 138 that extends to the right. The web 134 of the metallic rail 118 extends from the top flange 124 to the bottom flange 128 to impart a generally reverse, C-shaped configuration to an internal cavity 142 of the metallic rail 118. The cavity 142, which extends obliquely downwardly and outwardly to further help to minimize the spacing between the rails 116 and 118, has a restricted opening 144 that extends to the left. The top flanges 122 and 124 have downwardly depending portions 122*a* and 124*a*, respectively, each of which ends in an obliquely extending flat, planar sealing surface, elements 122*b* and 124*b*, respectively, which extend generally parallel to one another. The bottom flanges 126 and 128 have upwardly extending portions 126*a* and 128*a*, respectively, each of which ends in an obliquely extending flat, planar sealing surface, elements 126*b* and 128*b*, respectively, which extend generally parallel to one another. Thus, the opening 138 in the rail 116, which is the vertical spacing between the surface 122*b* and the surface 126*b*, has less vertical extent than the cavity 136 and is entirely spaced between the upper and lower extremities thereof, elements 136*a* and 136*b*, respectively, which are semi-circular in cross-sectional configuration. Likewise, the opening 144 in the rail 118, which is the vertical spacing between the surface 124*b* and the surface 128*b*, has less vertical extent than the cavity 142 and is entirely spaced between the upper and lower extremities thereof, elements 142*a* and 142*b* respectively, which are also semi-circular in cross-sectional configuration. The elastomeric membrane 120 can correspond to the membrane 20 of the embodiment of FIGS. 1 and 2, but is preferably altered slightly in its geometry to accommodate the obliquely extending flat, planar sealing surfaces 122*b*, 124*b*, 126*b*, 128*b* as opposed to the generally horizontal sealing surfaces 22*b*, 24*b*, 26*b*, 28*b* of the embodiment of FIG. 1, and to accommodate the obliquely extending cavity 136, 142 as opposed to the generally vertically extending cavities 36, 42 of the embodiment of FIG. 1.

Figure 5:
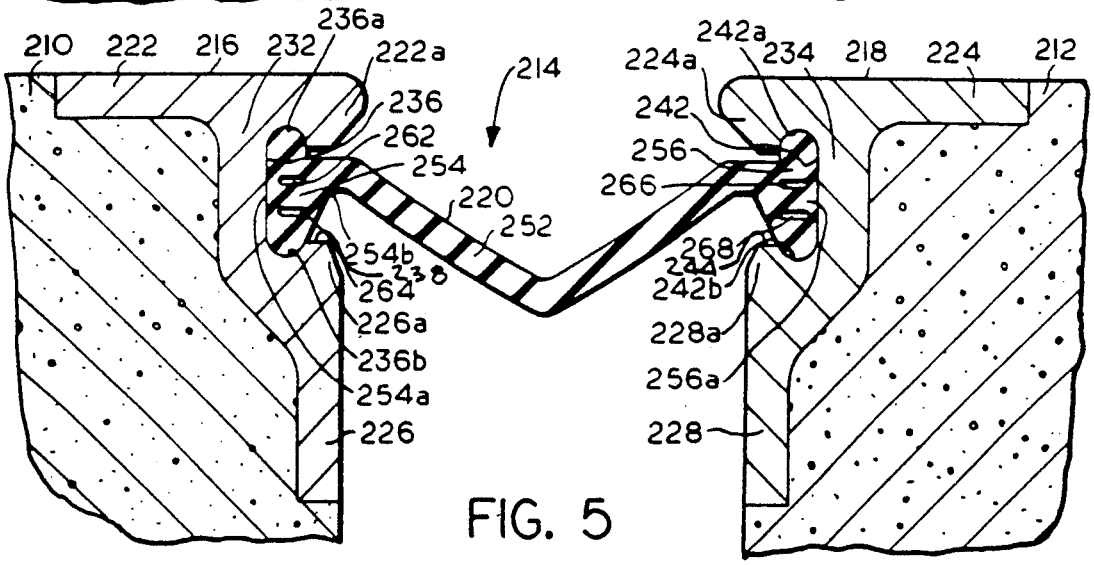
FIG. 5 is a view similar to FIGS. 1 and 4 illustrating another alternative embodiment of the present invention.

In the embodiment of FIG. 5 elements which generally correspond to elements of FIGS. 1 and 2 are identified by a 200 series numeral, the last two digits of which are the same as the two digits of the corresponding element of FIGS. 1 and 2. In FIG. 5 a strip seal 214 is made up of elongate metal rails 216 and 218 and an elongate elastomeric membrane 220 which extends between the metallic rails 216 and 218.

Each of the metallic rails 216 and 218, which are embedded in the spaced apart ends of adjacent concrete sections 210 and 212, are generally of the same configuration as the rails 116 and 118 of FIG. 4, although it is contemplated that the rails 216 and 218 could also be in the general configuration of the rails 16 and 18 of the embodiment of FIG. 1. Each of the metallic rails 216 and 218 is provided with a generally horizontally extending top flange, elements 222 and 224, respectively, a generally vertically extending bottom flange, elements 226 and 228, respectively, and a generally vertically extending web, elements 232 and 234, respectively. The web 232 of the metallic rail 216 extends from the top flange 222 to the bottom flange 226, to impart a generally C-shaped configuration to an internal cavity 236 of the metallic rail 216. The cavity 236, which extends generally vertically, has a restricted opening 238 that extends to the right. The web 234 of the metallic rail 218 extends from the top flange 224 to the bottom flange 228 to impart a generally reverse, C-shaped configuration to an internal cavity 242 of the metallic rail 218. The cavity 242, which extends generally vertically, has a restricted opening 244 that extends to the left. The top flanges 222 and 224 have downwardly depending portions 222*a* and 222*b*, respectively, and the bottom flanges 226 and 228 have upwardly extending portions 226*a* and 228*a*. Thus, the opening 238 in the rail 216, which is the vertical spacing between the bottom of the portion 222*a* and the top of the portion 226*a*, has less vertical extent than the cavity 236 and is entirely spaced between the upper and lower extremities thereof, elements 236*a* and 236*b*, respectively, which are semi-circular in cross-sectional configuration and which, therefore, define part-cylindrical surfaces that serve as sealing surfaces. Likewise, the opening 244 in the rail 218, which is the vertical spacing between the bottom of the portion 224*a* and the top of the portion 228*a*, has less vertical extent than the cavity 242 and is entirely spaced between the upper and lower extremities thereof, elements 242*a* and 242*b*, respectively, which are also semi-circular in cross-sectional configuration and which also, therefore, define part-cylindrical surfaces that serve as sealing surfaces.

The elongate elastomeric membrane 220 is formed integrally in a single piece from a suitable elastomeric material, as in the manner of the elastomeric membrane 20 of the embodiment of FIGS. 1 and 2. The membrane 220 has a generally horizontally extending web portion 252, which is generally V-shaped in cross section, and generally vertically extending, mirror image ear portions 254 and 256 which are attached to the opposed ends of the web portion 252, the V-shape of the web portion 252 facilitating the changes in spacing between the ear portions 254 and 256 to accommodate changes in spacing between the highway sections 210 and 212. The ear portion 254 has a free end 254*a* with upper and lower cylindrical sealing surfaces, and is sized and shaped to fit snugly within the cavity 236 of the rail 216. The ear portion 254 also has a transitional portion 254*b* which is sized and shaped, and positioned relative to the free end 254*a*, to fit within the opening 238 in the rail 216, with substantial clearance with respect to the portions 222*a* and 226*a* of the flanges 222 and 226. Likewise, the ear portion 256 has a free end 256*a* with upper and lower part-cylindrical sealing surfaces and is sized and shaped to fit snugly within the cavity 242 of the rail 218. The ear portion 256 also has a transitional portion 256*b* which is sized and shaped, and positioned relative to the free end 256*a*, to fit within the opening 244 in the rail 218 with substantial clearance with respect to the portions 224*a* and 228*a* of the flanges 224 and 228. Thus, the vertical extent of the free end 254*a* of the ear portion 254 of the membrane 220 are greater than the vertical extent of the opening 238 in the rail 216, and the free end 254*a* must be compressed in the vertical direction to permit it to be inserted through the opening 238 into the cavity 236 of the rail 216. To facilitate the compressing of the free end 254*a* of the ear portion 254, horizontally elongate internal cavities 262 and 264. Similarly, the vertical extent of the free end 256*a* of the ear portion 256 of the membrane 220 is greater than the vertical extent of the opening 244 in the rail 218, and the free end 256 is provided with spaced apart, horizontally extending elongate internal cavities 266 and 268 to facilitate the vertical compressing of the free end 256*a* to permit it to be inserted through the opening 244 into the cavity 242 of the rail 218. The cavity 262 is spaced a given distance from the top of the free end 254*a* of the ear 254 and the cavity 264 is spaced a slightly greater distance from the bottom of the free end 254*a*. Likewise, the cavity 266 is spaced a given distance from the top of the free end 256*a* of the ear 254 and the cavity 268 is spaced a slightly greater distance from the bottom of the free end 256*a*. As illustrated in FIG. 5, the transitional portion 254*a* of the ear 254 is positioned closer to the top of the free end 254*a* than to the bottom, and the transitional portion 256*b* of the ear 256 is positioned closer to the top of the free end 256*a*. Thus, when the web portion 252 is under tension, it will exert a turning moment on each of the ear portions 254 and 256 to thereby twist each such ear portion and increase its resistance to pullout.

Sealing contact between the ear portion 254 of the elastomeric membrane 220 and the rail 216 primarily occurs at the part-cylindrical surfaces 236*a* and 236*b* of the cavity 236 of the rail 216. Similarly, sealing contact between the ear portion 256 of the elastomeric membrane 220 and the rail 218 primarily occurs at the part-cylindrical surfaces 242*a* and 242*b* of the rail 218. To ensure proper surface to surface sealing engagement between the transitional portion 254*b* of the ear portion 254 and the opening 238 in the rail 216, and proper surface to surface sealing engagement between the transitional portion 256 of the ear portion 256 and the opening 244 in the rail 218, the relaxed or uncompressed spacing between the top and the bottom of the free end 254*a* must exceed the spacing between the surfaces 236*a* and 236*b*, and the relaxed or uncompressed spacing between the top and the bottom of the free end 256*a* must exceed the spacing between the surfaces 244*a* and 244*b*.

Figure 6:
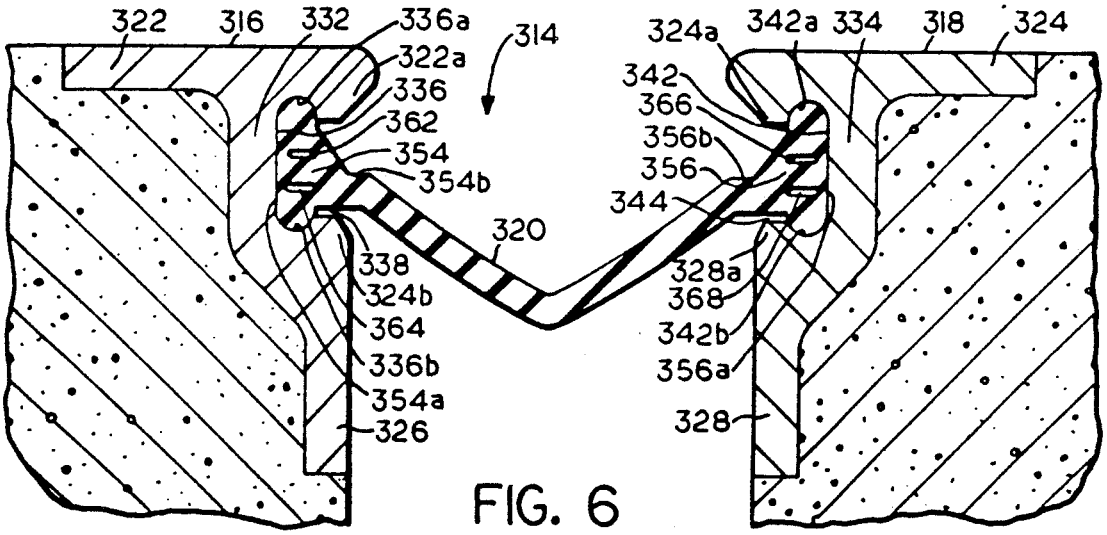
FIG. 6 is a view similar to FIG. 1 illustrating yet another alternative embodiment of the present invention.

In the embodiment of FIG. 6 elements which generally correspond to elements of FIGS. 1 and 2 are identified by a 300 series numeral, the last two digits of which are the same as the two digits of the corresponding element of FIGS. 1 and 2. In FIG. 6 a strip seal 314 is made up of elongate metal rails 316 and 318 and an elongate elastomeric membrane 320 which extends between the metallic rails 316 and 318.

Each of the metallic rails 316 and 318, which are embedded in the spaced apart ends of adjacent concrete sections 310 and 312, are generally of the same configuration as the rails 116 and 118 of FIG. 4, although it is contemplated that the rails 316 and 318 could also be in the general configuration of the rails 16 and 18 of the embodiment of FIG. 1. Each of the metallic rails 316 and 318 is provided with a generally horizontally extending top flange, elements 322 and 324, respectively, a generally vertically extending bottom flange, elements 326 and 328, respectively, and a generally vertically extending web, elements 332 and 334, respectively. The web 332 of the metallic rail 316 extends from the top flange 322 to the bottom flange 326, to impart a generally C-shaped configuration to an internal cavity 336 of the metallic rail 316. The cavity 336, which extends generally vertically, has a restricted opening 338 that extends to the right. The web 334 of the metallic rail 318 extends from the top flange 324 to the bottom flange 328 to impart a generally reverse, C-shaped configuration to an internal cavity 342 of the metallic rail 318. The cavity 342, which extends generally vertically, has a restricted opening 344 that extends to the left. The top flanges 322 and 324 have downwardly depending portions 322*a* and 324*b*, respectively, and the bottom flanges 326 and 328 have upwardly extending portions 326*a* and 328*a*. Thus, the opening 338 in the rail 316, which is the vertical spacing between the bottom of the portion 322*a* and the top of the portion 326*a*, has less vertical extent than the cavity 336 and is entirely spaced between the upper and lower extremities thereof, elements 336*a* and 336*b*, respectively, which are semi-circular in cross-sectional configuration and which, therefore, define part-cylindrical surfaces that serve as sealing surfaces. Likewise, the opening 344 in the rail 318, which is the vertical spacing between the bottom of the portion 324*a* and the top of the portion 328*a*, has less vertical extent than the cavity 342 and is entirely spaced between the upper and lower extremities thereof, elements 342*a* and 342*b*, respectively, which are also semi-circular in cross-sectional configuration and which also, therefore, define part-cylindrical surfaces that serve as sealing surfaces.

The elongate elastomeric membrane 320 is formed integrally in a single piece from a suitable elastomeric material, as in the manner of the elastomeric membrane 20 of the embodiment of FIGS. 1 and 2. The membrane 320 has a generally horizontally extending web portion 352, which is generally V-shaped in cross section, and generally vertically extending, mirror image ear portions 354 and 356 which are attached to the opposed ends of the web portion 352, the V-shape of the web portion 352 facilitating the changes in spacing between the ear portions 354 and 356 to accommodate changes in spacing between the highway sections 310 and 312. The ear portion 354 has a free end 354*a* with upper and lower cylindrical sealing surfaces, and is sized and shaped to fit snugly within the cavity 336 of the rail 316. The ear portion 354 also has a transitional portion 354*b* which is sized and shaped, and positioned relative to the free end 354*a*, to fit within the opening 338 in the rail 316, with substantial clearance with respect to the portions 322*a* and 326*a* of the flanges 322 and 326. Likewise, the ear portion 356 has a free end 356*a* with upper and lower part-cylindrical sealing surfaces and is sized and shaped to fit snugly within the cavity 342 of the rail 318. The ear portion 356 also has a transitional portion 356*b* which is sized and shaped, and positioned relative to the free end 356*a*, to fit within the opening 344 in the rail 318 with substantial clearance with respect to the portions 324*a* and 328*a* of the flanges 324 and 328. Thus, the vertical extent of the free end 354*a* of the ear portion 354 of the membrane 320 is greater than the vertical extent of the opening 338 in the rail 316, and the free end 354*a* must be compressed in the vertical direction to permit it to be inserted through the opening 338 into the cavity 336 of the rail 316. To facilitate the compressing of the free end 354*a* of the ear portion 354, the free end 354*a* is provided with spaced apart, horizontally elongate internal cavities 362 and 364. Similarly, the vertical extent of the free end 356*a* of the ear portion 356 of the membrane 320 is greater than the vertical extent of the opening 344 in the rail 318, and the free end 356 is provided with spaced apart, horizontally extending elongate internal cavities 366 and 368 to facilitate the vertical compressing of the free end 356*a* to permit it to be inserted through the opening 344 into the cavity 342 of the rail 318. The cavity 362 is spaced a given distance from the top of the free end 354*a* of the ear 354 and the cavity 364 is spaced a slightly greater distance from the bottom of the free end 354*a*. Likewise, the cavity 366 is spaced a given distance from the top of the free end 356*a* of the ear 354 and the cavity 368 is spaced a slightly greater distance from the bottom of the free end 356*a*. As illustrated in FIG. 6, the transitional portion 354*b* of the ear 354 is positioned further from the top of the free end 354*a* than from the bottom, and the transitional portion 356*b* of the ear 356 is positioned further from the top of the free end 356*a* than from the top. Thus, when the web portion 352 is under tension, it will exert a turning moment on each of ear portions 354 and 356 to thereby twist each such ear portion and increase its resistance to pullout.

Sealing contact between the ear portion 354 of the elastomeric membrane 320 and the rail 316 primarily occurs at the part-cylindrical surfaces 336*a* and 336*b* of the cavity 336 of the rail 316. Similarly, sealing contact between the ear portion 356 of the elastomeric membrane 320 and the rail 318 primarily occurs at the part-cylindrical surfaces 342*a* and 342*b* of the rail 318. To ensure proper sealing engagement between the transitional portion 354*b* of the ear portion 354 and the opening 338 in the rail 316, and proper sealing engagement between the transitional portion 356 of the ear portion 356 and the opening 344 in the rail 318, the relaxed or uncompressed spacing between the top and the bottom of the free end 354*a* must exceed the spacing between the surfaces 336*a* and 336*b*, and the relaxed or uncompressed spacing between the top and the bottom of the free end 356*a* must exceed the spacing between the surfaces 344*a* and 344*b*.

Figure 7:
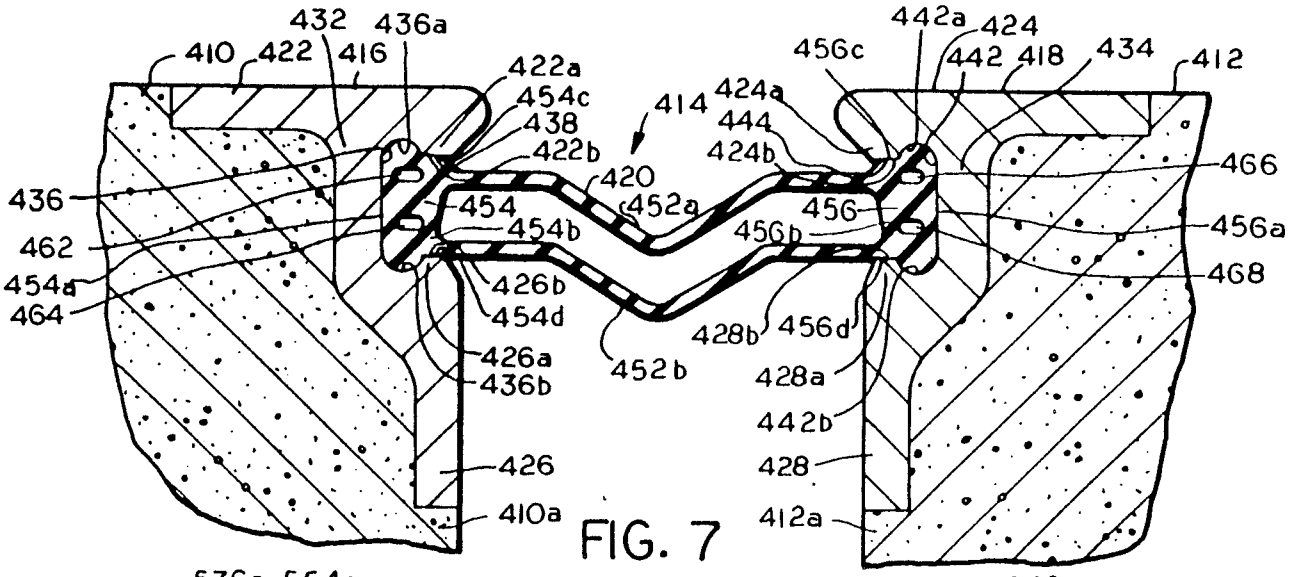
FIG. 7 is a view similar to FIG. 1 illustrating yet another alternative embodiment of the present invention.

In the embodiment of FIG. 7 elements which generally correspond to elements of FIGS. 1 and 2 are identified by a 400 series numeral, the last two digits of which are the same as the two digits of the corresponding element of FIGS. 1 and 2. In FIG. 7, a strip seal 414 is made up of elongate metallic rails 416 and 418 and an integrally formed, one piece, elongate elastomeric membrane 420 which extends between the metallic rails 416 and 418. The metallic rails 416 and 418, which preferably are hot rolled steel rails, are embedded in the spaced apart ends of adjacent concrete sections 410 and 412.

Each of the metallic rails 416 and 418, which are generally of the same configuration as the rails 216 and 218 of FIG. 5, respectively, is provided with a generally vertically extending top flange, elements 422 and 424, respectively, a generally horizontally extending bottom flange, elements 426 and 428, respectively, and a generally vertically extending web, elements 432 and 434, respectively. The web 432 of the metallic rail 416 extends from the top flange 422 to the bottom flange 426, to impart a generally C-shaped configuration to an internal cavity 436 of the metallic rail 416. The cavity 436, which extends generally vertically, has a restricted opening 438 that extends to the right. The web 434 of the metallic rail 418 extends from the top flange 424 to the bottom flange 428 to impart a generally reverse, C-shaped configuration to an internal cavity 442 of the metallic rail 418. The cavity 442, which extends generally vertically, has a restricted opening 444 that extends to the left. The top flanges 422 and 424 have downwardly depending portions 422*a* and 424*a*, respectively, each of which ends in a generally horizontally flat sealing surface, elements 422*b* and 424*b*, respectively, which extend generally parallel to one another. The bottom flanges 426 and 428 have upwardly extending portions 426*a* and 428*a*, respectively, each of which ends in a generally horizontal flat sealing surface, elements 426*b* and 428*b*, respectively, which extend generally parallel to one another. Thus, the opening 438 in the rail 416, which is the vertical spacing between the surface 422*b* and the surface 426*b*, has less vertical extent than the cavity 436 and is entirely spaced between the upper and lower extremities thereof, elements 436*a* and 436*b*, respectively, which are semi-circular in cross-sectional configuration. Likewise, the opening 444 in the rail 418, which is the vertical spacing between the surface 424*b* and the surface 428*b*, has less vertical extent than the cavity 442 and is entirely spaced between the upper and lower extremities thereof, elements 442*a* and 442*b* respectively, which are also semi-circular in cross-sectional configuration 520.

The elastomeric membrane 420 of the strip seal 414 differs from the membrane 20 of the strip seal 14 that it is provided with a spaced apart pair of generally horizontally extending web portions 452*a* and 452*b*, respectively, the lower of such web portions, the web portion 452*b*, serving to prevent moisture and debris from penetrating the space beneath the concrete sections 410 and 412. The membrane 420 also has generally vertically extending, mirror image ear portions 454 and 456 which are attached to the opposed ends of the web portions 452*a* and 452*b*, the V-shape of each of the web portions 452*a* and 452*b* facilitating the changes in spacing between the ear portions 454 and 456 to accommodate changes in spacing between the ends 410*a* and 412*a* of the highway sections 410 and 412. The ear portion 454 has a free end 454*a* which is sized and shaped to fit snugly within the cavity 436 of the rail 416, and a transitional portion 454*b* which is sized and shaped, and positioned relative to the free end 454*a*, to extend through and fit snugly within the opening 438 in the rail 416. Likewise, the ear portion 456 has a free end 456*a* which is sized and shaped to fit snugly within the cavity 442 of the rail 418, and a transitional portion 456*b* which is sized and shaped, and positioned relative to the free end 456*a*, to fit snugly within the opening 444 in the rail 418. Thus, the vertical extent of the free end 454*a* of the ear portion 454 of the membrane 420 is greater than the vertical extent of the opening 438 in the rail 416, and the free end 454*a* must be compressed in the vertical direction to permit it to be inserted through the opening 438 into the cavity 436 of the rail 416. To facilitate the compressing of the free end 454*a* of the ear portion 454, the free end 454*a* is provided with spaced apart, horizontally elongate internal cavities 462 and 464. Similarly, the vertical extent of the free end 456*a* of the ear portion 456 of the membrane 420 is greater than the vertical extent of the opening 444 in the rail 418, and the free end 454 is provided with spaced apart, horizontally extending elongate internal cavities 466 and 468 to facilitate the vertical compressing of the free end 456*a* to permit it to be inserted through the opening 444 into the cavity 442 of the rail 418.

Sealing contact between the ear portion 454 of the elastomeric membrane 420 and the rail 416 primarily occurs at the surfaces 422*b* and 426*b* of the rail 416, and to this end the transitional portion 454*b* of the ear portion 454 is provided with parallel, upper and lower surfaces 454*c* and 454*d*, respectively, which sealingly engage the surfaces 422*b* and 426*b*, respectively, of the rail 416. Similarly, sealing contact between the ear portion 456 of the elastomeric membrane 420 and the rail 418 primarily occurs at the surfaces 424*b* and 428*b* of the rail 418, and to this end the transitional portion 456*b* of the ear portion is provided with parallel, upper and lower surfaces 456*c* and 456*d*, respectively, which sealingly engage the surfaces 424*b* and 428*b*, respectively, of the rail 418. To ensure proper sealing engagement between the transitional portion 454*b* of the ear portion 454 and the opening 438 in the rail 416, and proper sealing engagement between the transitional portion 456*b* of the ear portion 456 and the opening 444 in the rail 418, the relaxed or uncompressed spacing between the surfaces 454*c* and 454*d* must exceed the spacing between the surfaces 422*b* and 426*b*, and the relaxed or uncompressed spacing between the surfaces 456*c* and 456*d* must exceed the spacing between the surfaces 424*b* and 428*b*.

Figure 8:
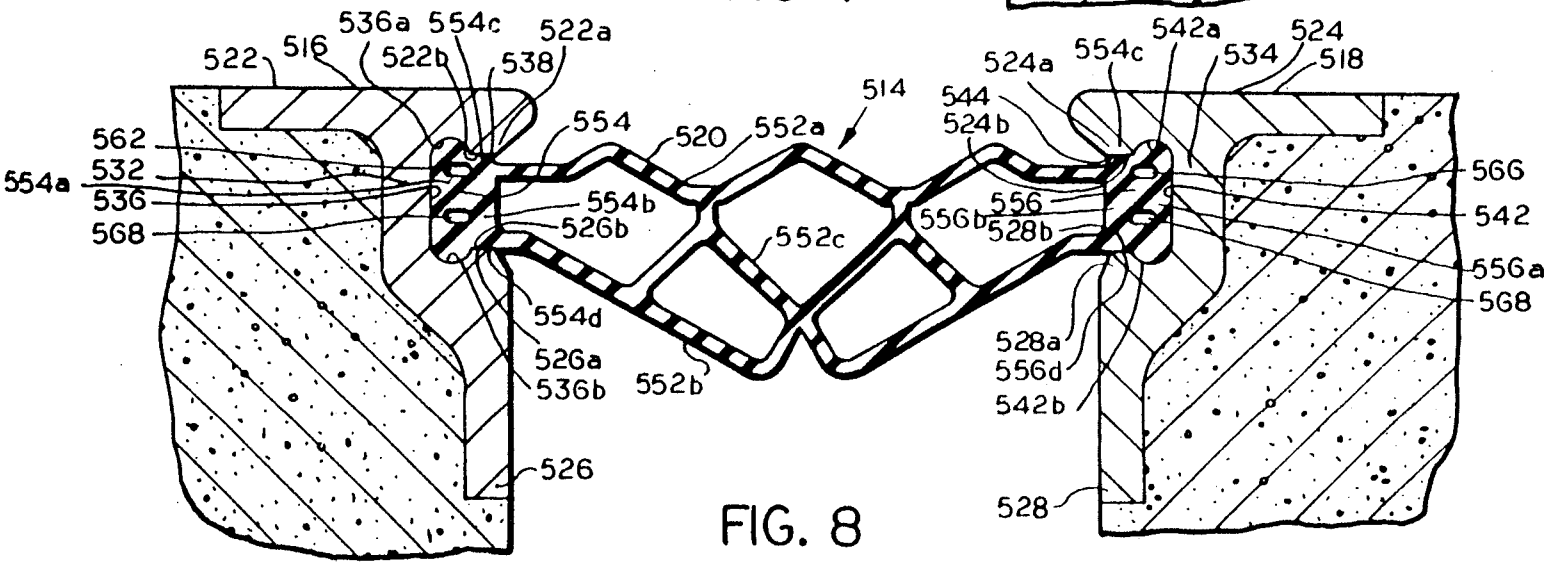
FIG. 8 is a view similar to FIG. 1 illustrating yet another alternative embodiment of the present invention.

In the embodiment of FIG. 8 elements which generally correspond to elements of FIGS. 1 and 2 are identified by a 500 series numeral, the last two digits of which are the same as the two digits of the corresponding element of FIGS. 1 and 2. In FIG. 8, a strip seal 514 is made up of elongate metallic rails 516 and 518 and an integrally formed, one piece, elongate elastomeric membrane 520 which extends between the metallic rails 516 and 518. The metallic rails 516 and 518, which preferably are hot rolled steel rails, are embedded in the spaced apart ends of adjacent concrete sections 510 and 512.

Each of the metallic rails 516 and 518, which are generally of the same configuration as the rails 216 and 218 of FIG. 5, respectively, is provided with a generally vertically extending top flange, elements 522 and 524, respectively, a generally horizontally extending bottom flange, elements 526 and 528, respectively, and a generally vertically extending web, elements 532 and 534, respectively. The web 532 of the metallic rail 516 extends from the top flange 522 to the bottom flange 526, to impart a generally C-shaped configuration to an internal cavity 536 of the metallic rail 516. The cavity 536, which extends generally vertically, has a restricted opening 538 that extends to the right. The web 534 of the metallic rail 518 extends from the top flange 524 to the bottom flange 528 to impart a generally reverse, C-shaped configuration to an internal cavity 542 of the metallic rail 518. The cavity 542, which extends generally vertically, has a restricted opening 544 that extends to the left. The top flanges 522 and 524 have downwardly depending portions 522*a* and 524*a*, respectively, each of which ends in a generally horizontally flat sealing surface, elements 522*b* and 524*b*, respectively, which extend generally parallel to one another. The bottom flanges 526 and 528 have upwardly extending portions 526*a* and 528*a*, respectively, each of which ends in a generally horizontal flat sealing surface, elements 526*b* and 528*b*, respectively, which extend generally parallel to one another. Thus, the opening 538 in the rail 516, which is the vertical spacing between the surface 522*b* and the surface 526*b*, has less vertical extent than the cavity 536 and is entirely spaced between the upper and lower extremities thereof, elements 536*a* and 536*b*, respectively, which are semi-circular in cross-sectional configuration. Likewise, the opening 544 in the rail 518, which is the vertical spacing between the surface 524*b* and the surface 528*b*, has less vertical extent than the cavity 542 and is entirely spaced between the upper and lower extremities thereof, elements 542*a* and 542*b* respectively, which are also semi-circular in cross-sectional configuration 520.

The elastomeric membrane 520 differs from the membrane 20 of the strip seal 14 in that it is provided with a spaced apart pair of generally horizontally extending web portions 552*a* and 552*b*, respectively, the lower of such web portions, the web portion 552*b*, serving to prevent moisture and debris from penetrating the space beneath the concrete sections 510 and 512. Further, the membrane 520 is provided with reinforcing rib means 552*c* extending between the upper web portion 552*a* and the lower web portion 552*b*. The membrane 520, thus, is useful in a strip seal which is subject to pedestrian traffic, for example, a strip seal for a floor in a parking garage. The membrane 520 also has generally vertically extending, mirror image ear portions 554 and 556 which are attached to the opposed ends of the web portions 552*a* and 552*b*, the V-shape of each of the web portions 552*a* and 552*b* facilitating the changes in spacing between the ear portions 554 and 556 to accommodate changes in spacing between the ends 510*a* and 512*a* of the highway sections 510 and 512. The ear portion 554 has a free end 554*a* which is sized and shaped to fit snugly within the cavity 536 of the rail 516, and a transitional portion 554*b* which is sized and shaped, and positioned relative to the free end 554*a*, to extend through and fit snugly within the opening 538 in the rail 516. Likewise, the ear portion 556 has a free end 556*a* which is sized and shaped to fit snugly within the cavity 542 of the rail 518, and a transitional portion 556*b* which is sized and shaped, and positioned relative to the free end 556*a*, to fit snugly within the opening 544 in the rail 518. Thus, the vertical extent of the free end 554*a* of the ear portion 554 of the membrane 520 is greater than the vertical extent of the opening 538 in the rail 516, and the free end 554*a* must be compressed in the vertical direction to permit it to be inserted through the opening 538 into the cavity 536 of the rail 516. To facilitate the compressing of the free end 554*a* of the ear portion 554, the free end 554*a* is provided with spaced apart, horizontally elongate internal cavities 562 and 564. Similarly, the vertical extent of the free end 556*a* of the ear portion 556 of the membrane 20 is greater than the vertical extent of the opening 544 in the rail 518, and the free end 554 is provided with spaced apart, horizontally extending elongate internal cavities 566 and 568 to facilitate the vertical compressing of the free end 556*a* to permit it to be inserted through the opening 544 into the cavity 542 of the rail 518.

Sealing contact between the ear portion 554 of the elastomeric membrane 520 and the rail 516 primarily occurs at the surfaces 522*b* and 526*b* of the rail 516, and to this end the transitional portion 554*b* of the ear portion 554 is provided with parallel, upper and lower surfaces 554*c* and 554*d*, respectively, which sealingly engage the surfaces 522*b* and 526*b*, respectively, of the rail 516. Similarly, sealing contact between the ear portion 556 of the elastomeric membrane 520 and the rail 518 primarily occurs at the surfaces 524*b* and 528*b* of the rail 518, and to this end the transitional portion 556*b* of the ear portion is provided with parallel, upper and lower surfaces 556*c* and 556*d*, respectively, which sealingly engage the surfaces 524*b* and 528*b*, respectively, of the rail 518. To ensure proper sealing engagement between the transitional portion 554*b* of the ear portion 554 and the opening 538 in the rail 516, and proper sealing engagement between the transitional portion 556*b* of the ear portion 556 and the opening 544 in the rail 518, the relaxed or uncompressed spacing between the surfaces 554*c* and 554*d* must exceed the spacing between the surfaces 522*b* and 526*b*, and the relaxed or uncompressed spacing between the surfaces 556*c* and 556*d* must exceed the spacing between the surfaces 524*b* and 528*b*.

Although the best mode contemplated by the inventor for carrying out the present invention as of the filing date hereof has been shown and described herein, it will be apparent to those skilled in the art that suitable modifications, variations, and equivalents may be made without departing from the scope of the invention, such scope being limited solely by the terms of the following claims.

What is claimed is:

1. A strip seal for use between the spaced apart ends of adjacent sections of a highway, bridge, or the like, said strip seal comprising:

a membrane, said membrane comprising;

a web portion having first and second opposed edges, a first ear portion attached to the first of the opposed edges of the web portion, a second ear portion attached to the second of the opposed edges of the web portion, each of the first ear portion and the second ear portion extending generally normally to the web portion and having an enlarged end portion and a transitional portion attached to said enlarged end portion and positioned between said enlarged end portion and the edge of the web portion to which said each of the first ear portion and the second ear portion is attached, each enlarged end portion having an upper part-cylindrical sealing surface and a lower part-cylindrical sealing surface, each transitional portion further being attached to the edge of the web portion to which the ear portion incorporating said transitional portion is attached at a location on said transitional portion which is substantially closer to one of the upper sealing surface and the lower sealing surface thereof than to the other;

a first elongate rail, said first elongate rail being formed from a rigid material and having an internal cavity which is generally C-shaped in transverse cross section, the free end of the first ear portion of the membrane being snugly contained in said internal cavity, said internal cavity having an opening through which the transitional portion of the first ear portion passes with clearance above and below said transitional portion continuously along said opening of said internal cavity, the internal cavity having an upper, part-cylindrical sealing surface which sealingly engages the upper, part-cylindrical sealing surface of the first ear portion in surface to surface contact and a lower part-cylindrical surface which sealingly engages the lower part-cylindrical sealing surface of the first ear portion in surface to surface contact; and a second elongate rail, said second elongate rail being formed from a rigid material and having a second internal cavity which is generally reverse C-shaped in transverse cross section, the free end of the second ear portion being snugly contained in said second internal cavity, said second internal cavity having an opening through which the transitional portion of the second ear portion passes with clearance above and below said transitional portion continuously along said opening of said second internal cavity, said second internal cavity having an upper part-cylindrical sealing surface to surface contact and a lower part-cylindrical sealing surface which sealingly engages the upper part-cylindrical sealing surface of the second ear portion in surface which sealingly engages the lower part-cylindrical sealing surface of the second ear portion in surface to surface contact.

2. A strip seal according to claim 1 wherein the web portion, the first ear portion and the second ear portion of the membrane are formed integrally in a single piece from an elastomeric material and further comprising;

elongate void means within the enlarged end portion of each of the first ear portion and the second ear portion of the membrane to facilitate the compressing of each said enlarged end portion in a direction transverse to its upper limit and its lower limit.

3. A strip seal comprising to claim 2 wherein said elongate void means comprises;

upper and lower spaced apart voids.

4. A strip seal according to claim 3 wherein said web portion of said membrane is generally V-shaped in transverse cross section.

5. A strip seal according to claim 4;

wherein the first ear portion of said membrane has a first configuration;

wherein the second ear portion of said membrane has a second configuration; and wherein the second configuration is a mirror image of the first configuration.

* * * * *

UNITED STATES PATENT AND TRADEMARK OFFICE

CERTIFICATE OF CORRECTION

PATENT NO. : 5,071,282

DATED : December 10, 1991

INVENTOR(S) : Howard R. Brown

It is certified that error appears in the above-identified patent and that said Letters Patent is hereby corrected as shown below:

In Claim 1, delete the following text which appears in lines 9 and 10 of Column 15: "which sealingly engages the upper part-cylindrical sealing surface of the second ear portion in surface" and insert this text in Claim 1 at line 7 of Column 15 between the words "surface" and "to": --which sealingly engages the upper part-cylindrical sealing surface of the second ear portion in surface--.

Signed and Sealed this

Sixteenth Day of November, 1993

Bruce Lehman

*Attest:*

BRUCE LEHMAN

*Attesting Officer*

*Commissioner of Patents and Trademarks*